United States Patent [19]

Edwards et al.

[11] 4,373,363

[45] Feb. 15, 1983

[54] SKIN WASHER

[75] Inventors: Robert E. Edwards, Inverness; Donald H. McKee, Waukegan; Claude D. Brown, Hanover Park, all of Ill.

[73] Assignee: The Roy M. Moffitt Company, Schiller Park, Ill.

[21] Appl. No.: 189,056

[22] Filed: Sep. 22, 1980

[51] Int. Cl.[3] ..... C14C 1/00

[52] U.S. Cl. ..... 69/28; 69/32

[58] Field of Search ..... 69/28, 29, 32

[56] References Cited

U.S. PATENT DOCUMENTS

| | | | |
|---|---|---|---|
| 577,402 | 2/1897 | Bright . | |
| 1,195,859 | 8/1916 | Ruhe . | |
| 1,233,709 | 7/1917 | Ruhe . | |
| 2,384,691 | 9/1945 | Notte et al. | 69/28 |
| 2,479,466 | 8/1949 | Braun | 69/28 |
| 3,938,356 | 2/1976 | Arendt | 69/32 |

*Primary Examiner*—Patrick D. Lawson

*Attorney, Agent, or Firm*—Wegner, McCord, Wood & Dalton

[57] ABSTRACT

A skin washer having a conveyor belt which carries a skin from a loading station to and through a washing station with back-up members for the conveyor belt at the washing station. A plurality of driven brush rollers, located to deflect the conveyor belt between the back-up members, cause a partial wrap of a skin carried by the conveyor belt around the brush rollers for good cleaning action by the brush rollers. The skin washer includes a reversible drive for a first of the brush rollers whereby the first brush roller rotates in a skin-advancing direction as a skin is conveyed into the washing station and thereafter is caused to rotate in a direction opposite to that of skin travel for exerting a retarding force on the trailing portion of the skin.

18 Claims, 6 Drawing Figures

86
83
85
82
80
72
38
94
87
96
95
97
90
89
81
88
60
45
93
125a
126
102
101
92
35
91
125
46
100
103
73
61
111
113
114
110
39
77
115
117
116
112
75
76

85
68
67
66
18
62
180
65
17
34
72
160
181
63
87
161
S
50
69
162
60
163
165
164
38
70
64
125
45
100
15a
126
35
52
46
39
61
121
120
33
73
29
76
12
75
10

85
68
67
66
34
18
62
180
65
17
181
69
63
72
160
162
161
50
S
60
163
165
164
38
70
64
100
125
45
15a
126
61
46
35
52
39
51
120
33
73
121
29
76
12
75
10

SKIN WASHER

BACKGROUND OF THE INVENTION

This invention pertains to a skin washer for removal of a material, such as paste, from one side of a skin and which provides for improved handling of the skin and a good cleaning action with a minimum number of cleaning components, such as driven brush rollers.

In the processing of various animal skins, it is a common practice to mount a skin to a plate for travel through a dryer and with the skin being adhesively secured to the plate to minimize shrinkage of the skin during drying thereof. After leaving the dryer, the skin is removed from the plate and it is necessary to clean the side of the skin which was exposed to the adhesive. It has been known to remove the adhesive by the use of a skin washer wherein the unit has an entry end and the skin then passes by a series of rotating washing members which contact a side of the skin along with application of water for removal of the adhesive and the skin then is delivered to the opposite end of the unit for further processing. Such skin washers commonly have a large number of sequentially-spaced driven members which operate to wash the skin.

SUMMARY OF THE INVENTION

A primary feature of the invention disclosed herein is to provide a skin washer which washes one side of a skin with minimum handling and with a compact unit having a minimal number of cleaning elements. This is accomplished by delivery of the skin to a washing station by a conveyor belt which is supported by back-up members at the washing station and with a pair of driven brush rollers at the opposite side of the conveyor and which are positioned relative to a plane of support for the conveyor belt by the back-up members to concavely deflect the conveyor belt and, thereby, increase the arc of contact of said brush rollers with a skin supported on the conveyor belt.

In carrying out the foregoing, the back-up members are in the form of driven rollers which are in vertically-spaced relation to define a generally vertical plane of support for the conveyor belt and with the conveyor belt passing through a loading station at one end of the skin washer and delivering a skin to the washing station. The skin travels downwardly through the washing station for washing one side thereof and can be discharged from the conveyor belt beneath the washing station for either return to a location beneath the loading station so that the skin washer can be operated by a single operator or for delivery to an opposite end of the skin washer for further handling.

Another feature of the invention is to provide a skin washer wherein the skin is delivered through a washing station on a conveyor belt without being attached thereto and with a pair of vertically-spaced driven brush rollers disposed at one side of the conveyor belt for successive contact with the skin and with the driven brush roller nearest the discharge end of the washing station being continuously driven in the direction of travel of the skin through the washing station. The first of the driven brush rollers at the entry end of the washing station is initially driven in the same direction as the path of skin travel as the skin enters the washing station and subsequently has its direction of travel reversed to travel in a direction opposite to that of the path of skin travel in order to exert a retarding force on the trailing part of the skin to insure tautness of the skin through the washing station and prevention of wrinkles therein.

Other features of the invention relate to mounting of the structure on two separate frames, with one being adjustable relative to the other whereby the structure can be adjusted for different thicknesses of skins; the control of the reversibility of the first of the driven brush rollers by means of a switch which is selectively contacted by a skin whereby the presence of a skin at the switch causes the first driven brush roller to rotate in the direction of skin travel and the absence of a skin at the switch is an indication that the trailing edge of the skin is approaching the washing station and thereby the first of the driven brush rollers is caused to rotate in a direction opposite to the path of skin travel; and, said switch being adjustably mounted in order to accommodate control of the first-driven brush roller with respect to the length of skin which is passing through the skin washer.

In carrying out the foregoing, it is an object of the invention to provide a skin washer having a base, a first frame fixed to and upstanding from said base, a second frame extending upwardly from said base in a position adjacent said first frame, means adjustably mounting said second frame for movement toward and away from said first frame, a skin washing station located between said frames including a plurality of spray nozzles, an endless conveyor belt mounted on said first frame for travel between a loading station and said washing station, a series of vertically-spaced driven back-up rollers on said first frame at one side of said conveyor belt at said washing station, a pair of vertically-spaced driven brush rollers on the second frame and at the opposite side of the conveyor belt and located to deflect portions of the belt between the back-up rollers into a partial wrap on the brush rollers, feed means for feeding a skin on the conveyor belt from a generally horizontal path into a generally vertical path at the washing station and toward a first of the brush rollers, means for removing a skin from the conveyor belt at a location beyond the washing station, and means for causing said pair of brush rollers to rotate in a skin-advancing direction as a skin initially enters and travels through said washing station and for causing said first brush roller to change direction of rotation and rotate in a skin-retarding direction in advance of a skin leaving the washing station to exert a resisting force on a trailing part of the skin as the skin advances through the washing station.

DESCRIPTION OF THE PREFERRED EMBODIMENT

Figure 1:
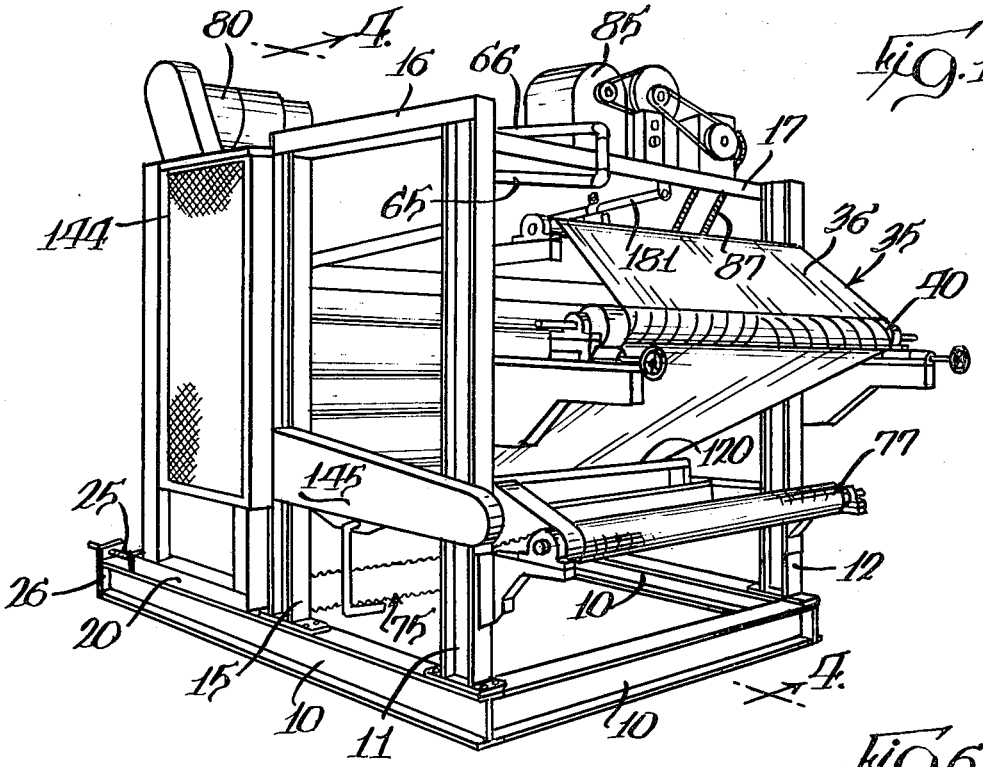
FIG. 1 is a perspective elevational view of the skin washer looking toward a front corner thereof.
Figure 2:
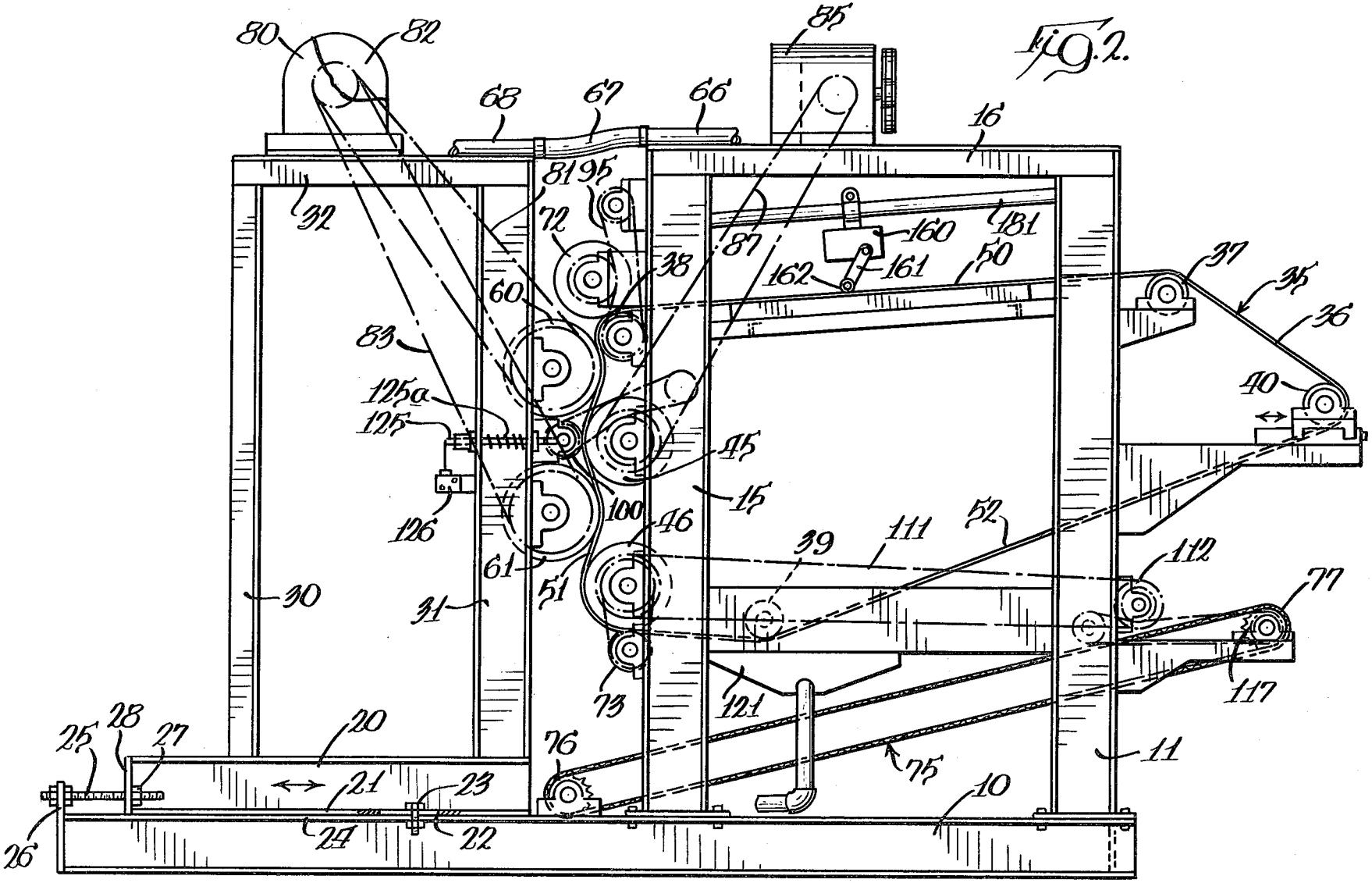
FIG. 2 is a front elevational view of the skin washer with access doors and chain guards removed.

The skin washer is shown generally in FIGS. 1 and 2 and has a generally rectangular base with a series of perimetral base members 10 interconnected and supporting a pair of frames. A first frame is fixed to and upstands from the base members 10. This first frame includes a pair of upright corner support members 11 and 12 and a pair of end support members, one of which is shown at 15, and with the other support member 15*a* being in alignment therewith and supported from an opposite base member. The support members 11, 12, 15, and 15*a* are secured at their lower ends to the base members 10 and are interconnected at the top to provide a rigid structure, as by connecting members 16, 17 and 18.

A second frame is adjustable relative to the first frame and has a pair of horizontally-extending slide members movably mounted on the top of the front and rear base members 10. As shown in FIG. 2, the slide member 20 has a flange 21 with a slot 22 through which a tightening bolt 23 extends as well as through an opening in a flange 24 of the base member 10. The second frame can be shifted lengthwise of the base members 10 by rotatable threaded members including a threaded member 25 which is rotatably-mounted in an end flange 26 affixed to the base member 10 and threaded into a nut 27 affixed to an end flange 28 of the slide member 20. A slide member 29, at the rear side of the second frame, is constructed the same as the slide member 20, at the front of the frame, and has similar structure associated therewith.

The second frame has a pair of upright front support members 30 and 31 extending upwardly from the slide member 20 and secured thereto and interconnected at their tops by a transverse member 32, with there being similar rear upright support members at the rear of the second frame including support member 33 and the support members at the front and rear of the second frame are interconnected by transverse members at the top thereof, such as member 34.

The first frame mounts an endless conveyor belt, indicated generally at 35, which has an inclined section 36 travelling upwardly, as viewed in FIGS. 1 and 2, and which defines a loading station for a skin. The conveyor belt has a path defined by a driven roller 38*a* and a series of idler rollers 37 and 39 which are supported by frame elements connected to structure of the first frame. Additional structure for guiding the conveyor belt 35 includes an idler-straightener roll 40 at an end of the machine constructed in a known manner with spiral surfaces, as shown in FIG. 1, which maintain the conveyor belt centered and at full width. The conveyor belt is a relatively smooth member formed of a suitable plastic material whereby the spirals of the idler-straightener roll 40 are visible, as shown in FIG. 1.

The conveyor belt 35 passes through a washing station and has a plane of support which extends generally vertically and is defined at its upper end by the driven roller 38 as well as a pair of back-up members engageable with an inner side of the conveyor belt. These back-up members are in the form of a pair of driven rollers 45 and 46 which are in vertically spaced-apart relation. With the structure as described in association with the conveyor belt 35, it will be noted that the conveyor belt has the upwardly-inclined section 36 providing the loading station and there is then a generally horizontal section 50 of the conveyor belt which travels toward the washing station, a section 51 which travels through the washing station in a downward direction, and then a slightly inclined section 52 which returns to the idler-straightener roll 40.

Figure 4:
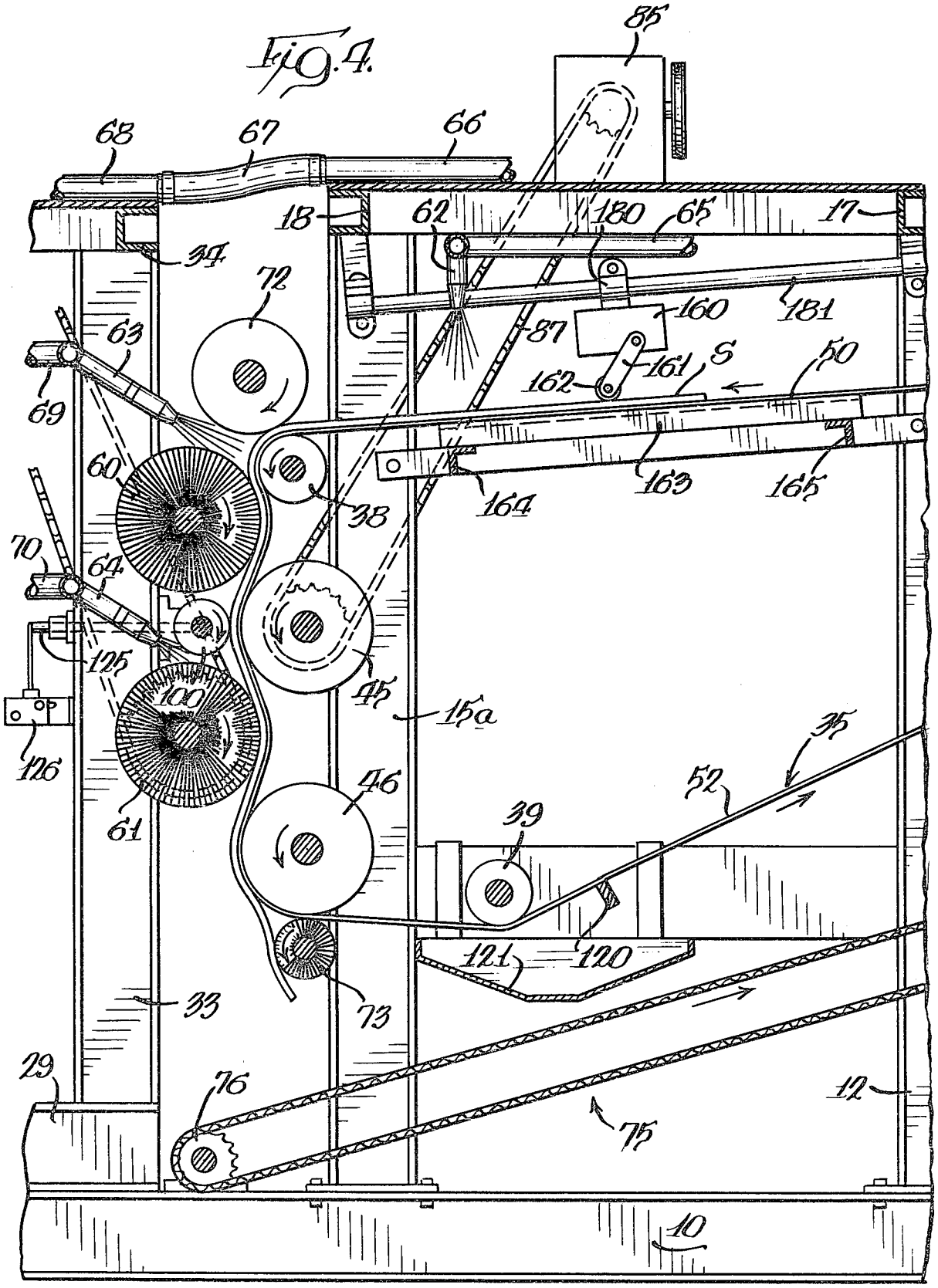
FIG. 4 is a fragmentary vertical section showing the structure as viewed in FIG. 2 and taken immediately to the rear of the front frame supports shown in FIG. 2.
Figure 5:
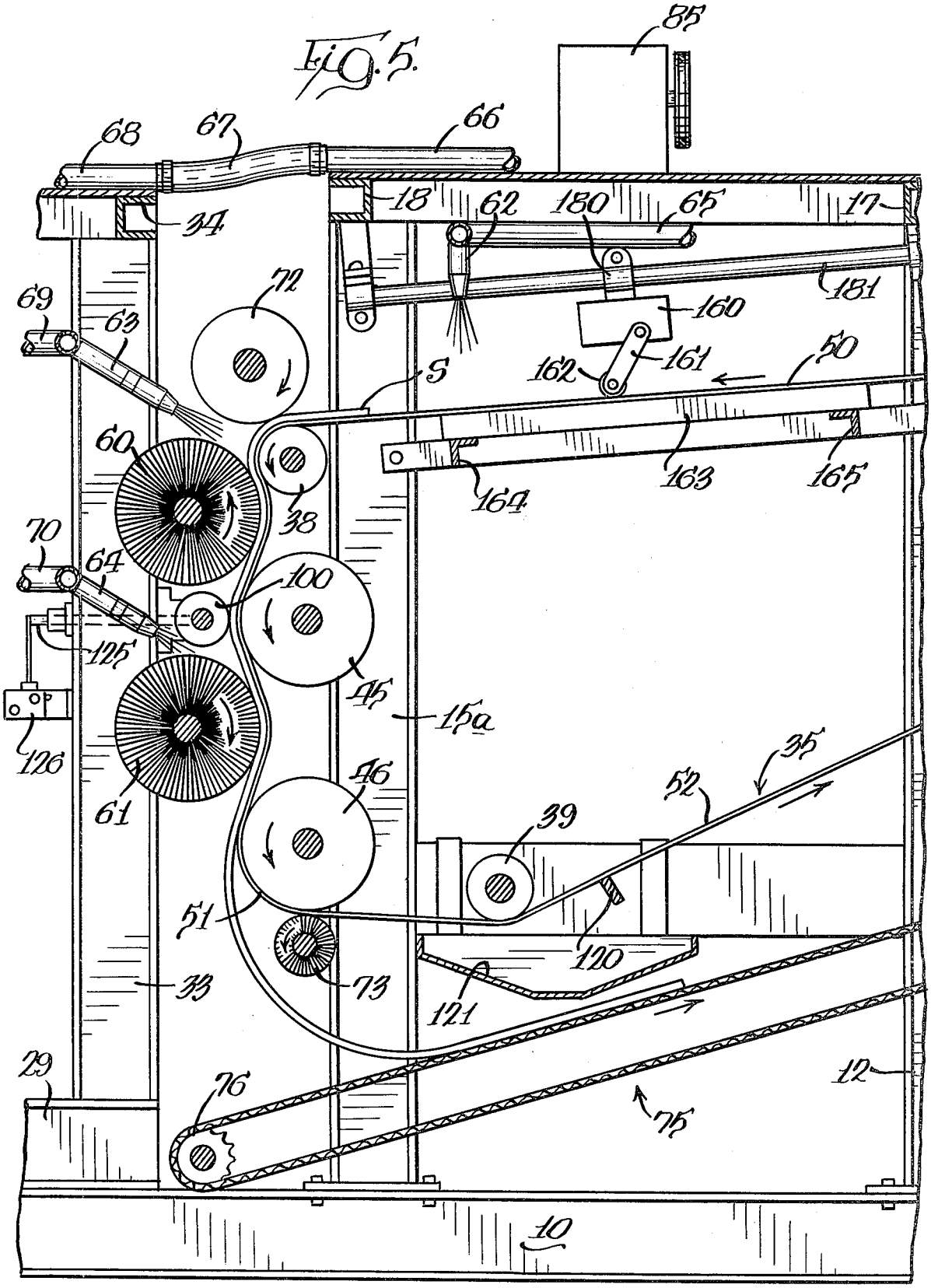
FIG. 5 is a view, similar to FIG. 4, and differing therefrom in showing the skin at a different location in the washing station and indicating a different direction of rotation of a driven brush roller.

The washing station has a pair of vertically-spaced driven brush rollers 60 and 61 located at a side of the conveyor belt 35 opposite the back-up rollers 45 and 46 and which are positioned to extend across the generally vertical plane of support for the conveyor belt to concavely deflect the conveyor belt in sections thereof between the back-up rollers to increase the wrap contact of a skin with the brush rollers. The brush rollers are of a structure commercially available from the 3M company and provide a slightly abrasive surface whereby rotation of the brush rollers relative to the surface of the skin and with application of water causes removal of the adhesive from a side of the skin. The water is applied by means of three series of spray nozzles, with one series extending from front to rear of the skin washer and overlying the section 50 of the conveyor belt to apply water to one side of the skin in advance of the washing station. One of the nozzles 62 of this series is shown in FIGS. 4 and 5. There is a second series of spray nozzles, one of which is shown at 63, which directs water onto the driven brush roller 60 along the length thereof and one side of the skin. A third series of spray nozzles is disposed beneath the series of nozzles 63 and with one of the nozzles indicated at 64 which directs water against the lower driven brush roller 61 and the same side of the skin. The spray nozzles are supplied with water from a connection at the loading station end of the skin washer, with a first pipe 65 leading to the series of nozzles 62. A connecting pipe 66 extends across the top of the first frame and is connected by a flexible hose 67 to a pipe 68 mounted on the second frame and which is connected by pipes 69 and 70 to the series of nozzles 63 and 64. The flexible hose connection 67 enables adjustment of the first and second frames relative to each other.

Additional skin-conveying and handling structure includes feed means located adjacent the end of the section 50 of the endless belt 35 in the form of a roll couple including the previously-referred to driven roller 38 and a driven roller 72. A skin release roller, in the form of a brush roller 73, is located at the bottom of the washing station for coaction with the section 52 of the conveyor belt to assure release of a skin from the conveyor belt surface for discharge thereof from the washing station.

Before referring to the specific drive mechanism for the components of the skin washer, the operation may be generally described.

An operator places a skin S on the conveyor belt 35 at the loading station and the skin is advanced along the conveyor belt section 50 to the feed means and there the skin is caused to turn into the vertically-extending plane of support of the washing station and pass between the first driven brush roller 60 and the roller 38 forming part of the feed means. Thereafter, the skin travels downwardly and, as shown in FIG. 4, the driven brush release roller 73 causes the leading edge of the skin to move away from the conveyor belt and move downwardly. The direction of removal of the skin from the skin washer is optional with there being a clear path between the upright frame members for conveying thereof to the left-hand end of the skin washer, as viewed in FIGS. 1 and 4. However as shown, an endless conveyor, indicated generally at 75, has its upper reach travelling to the right, as viewed in the drawings, for return of the skin to a location beneath the loading station whereby one operator can perform the tasks of both loading and unloading the skin washer. The endless conveyor travels about an idler 76 at the lower end thereof and about a driven roller 77 at the upper end, which is driven in a manner to be described.

Figure 3:
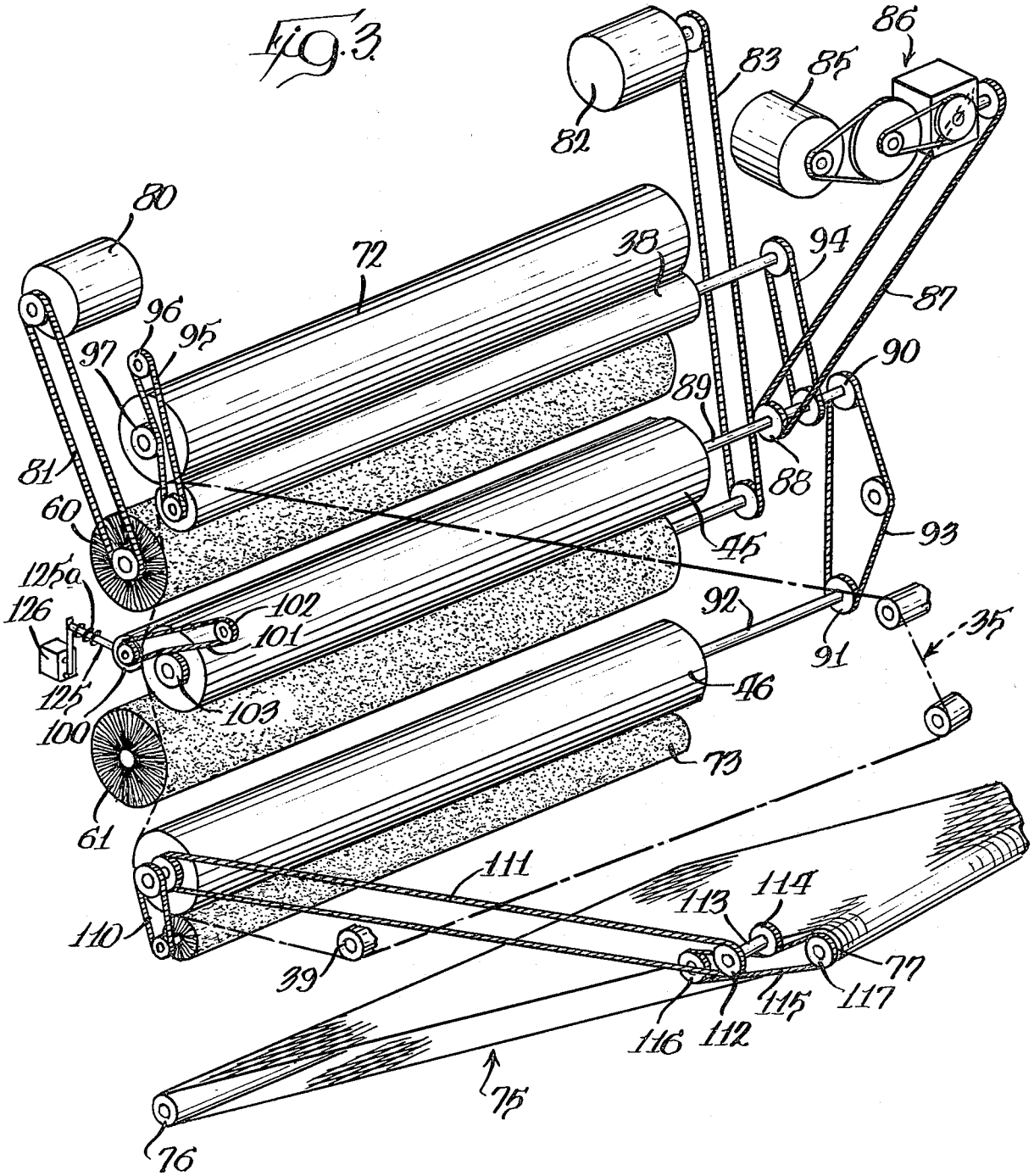
FIG. 3 is a perspective schematic view of the driven structure of the skin washer with one edge of an endless conveyor belt shown in broken line.

The drive mechanism is best shown in the perspective view of FIG. 3. The first driven brush roller 60, which is rotatably mounted in bearings supported on the second frame, is driven by a reversible motor 80 by a chain and sprocket drive 81. The second driven brush roller 61 is bearing-mounted and driven by a unidirectional motor 82 through a chain and sprocket drive 83. The back-up rollers 45 and 46 are driven by a motor 85 which, through interconnecting structure including a variable speed drive and a gearbox, indicated generally at 86, drives a chain 87 extending to a sprocket 88 on the mounting shaft 89 of the back-up roller 45. The second back-up roller 46 is driven from the mounting shaft 89 by means of a sprocket 90 on the mounting shaft 89 which is connected to a sprocket 91 on the roller shaft 92 by a chain 93. The feed means including the driven roller 38 and roller 72 are driven from the mounting shaft 89 through a chain and sprocket drive including the chain 94 which drives a sprocket on the shaft of the driven roller 38. The opposite end of the driven roller 38 has its shaft driving a chain 95 which passes about an idler 96 and intermediate its length engages a sprocket 97 associated with the roller 72. A floatingly-mounted roller 100 aids in guiding the skin through the washing station and also detects any possible jam of the skin within the washing station. This roller 100 is positioned opposite the back-up roller 45 and is driven therefrom, as seen in FIG. 3, by a chain 101 extended between a sprocket on the shaft for roller 100 and an idler sprocket 102 and intermediate its ends engaing a sprocket 103 on the shaft of the roller 45.

With the drive structure described in a preferred embodiment, the conveyor belt 35 can be driven at an approximate speed of 45 feet per minute, but with this speed being variable through the variable speed drive included in the structure 86 and the driven brush rollers 60 and 61 are driven by their respective motors at a speed of approximately 310–320 rpm.

The drive for the conveyor belt 75 is also shown in FIG. 3, as is the drive for the release brush roller 73. The release brush roller 73 is driven from the lower back-up roller 46 by a connecting chain and sprocket drive including the chain 110. The conveyor belt 75 is driven by a chain 111 which extends from a sprocket on the shaft of the lower back-up roller 46 to a sprocket 112 on an idler shaft 113 at an end of the machine and which has a sprocket 114 engaging an intermediate length of a chain 115 which extends between an idler sprocket 116 affixed to the frame and a sprocket 117 on the drive roller 77 for the conveyor belt.

The direction of rotation of various rotatable members of the skin washer is shown by arrows applied to the members in FIGS. 4 and 5. As a skin S advances into and through the washing station all of the members are rotating in the directions indicated by the arrows shown in FIG. 4. The direction of rotation of the feed means including the rollers 38 and 72 assists in directing the skin S to turn downwardly into the plane of support defined by the conveyor belt, with the back-up rollers 45 and 46 advancing the conveyor belt 35 and the driven brush rollers 60 and 61 rotating in the direction of skin advance through the washing station but at a great surface speed for not only advancing the skin S but also having relative movement with respect thereto for a good scrubbing and washing action. The feed means having driven rollers 38 and 72 holds the skin to the conveyor 35 for advance at the speed thereof. The release brush roller 73 rotates in a direction opposite to the path of travel of the endless conveyor 35 whereby the leading edge of the skin S is removed from the surface of the belt and the skin is caused to travel downwardly toward the endless conveyor 75. Referring to FIG. 5, it will be noted that all of the rotatable members have the same direction of rotation as previously indicated, except for the first driven brush roller 60 which is now shown as rotating in a counterclockwise direction, which is opposite to the direction of skin travel. This reversal of rotation exerts a retarding force on the trailing part of the skin S, as shown in FIG. 5, whereby the trailing part of the skin as it leaves the feed means defined by rollers 38 and 72 cannot be rapidly advanced into the washing station with jamming and possible wrinkling of the skin, but is actually retarded to keep the skin in a good, taut condition as it passes through the washing station. The reversal of direction of rotation of the driven brush roller 60 is accomplished by structure to be described.

The skin washer additionally has a doctor blade 120 extending from front to rear and which engages the underside of the conveyor belt section 52 to remove water from the conveyor belt which can fall into a collection trough 121 for removal from the machine.

In the event that there is a jam of the skin in the washing station, the driven roller 100 is provided to sense said jam and stop the operation of the machine. The roller 100 has a length to extend from front to rear of the machine and is mounted at its opposite ends on a pair of floating guide rods, with the front rod being shown at 125. The rods are spring-urged by a spring **125*a* in a direction to urge the roller 100 towards the back-up roller 45. In the event there is a jam, the guide rods 125 are urged toward the left end of the machine, as shown in FIG. 2, whereby a rod end engages and moves a switch arm of a switch 126** which is in a circuit to stop the machine.

Figure 6:
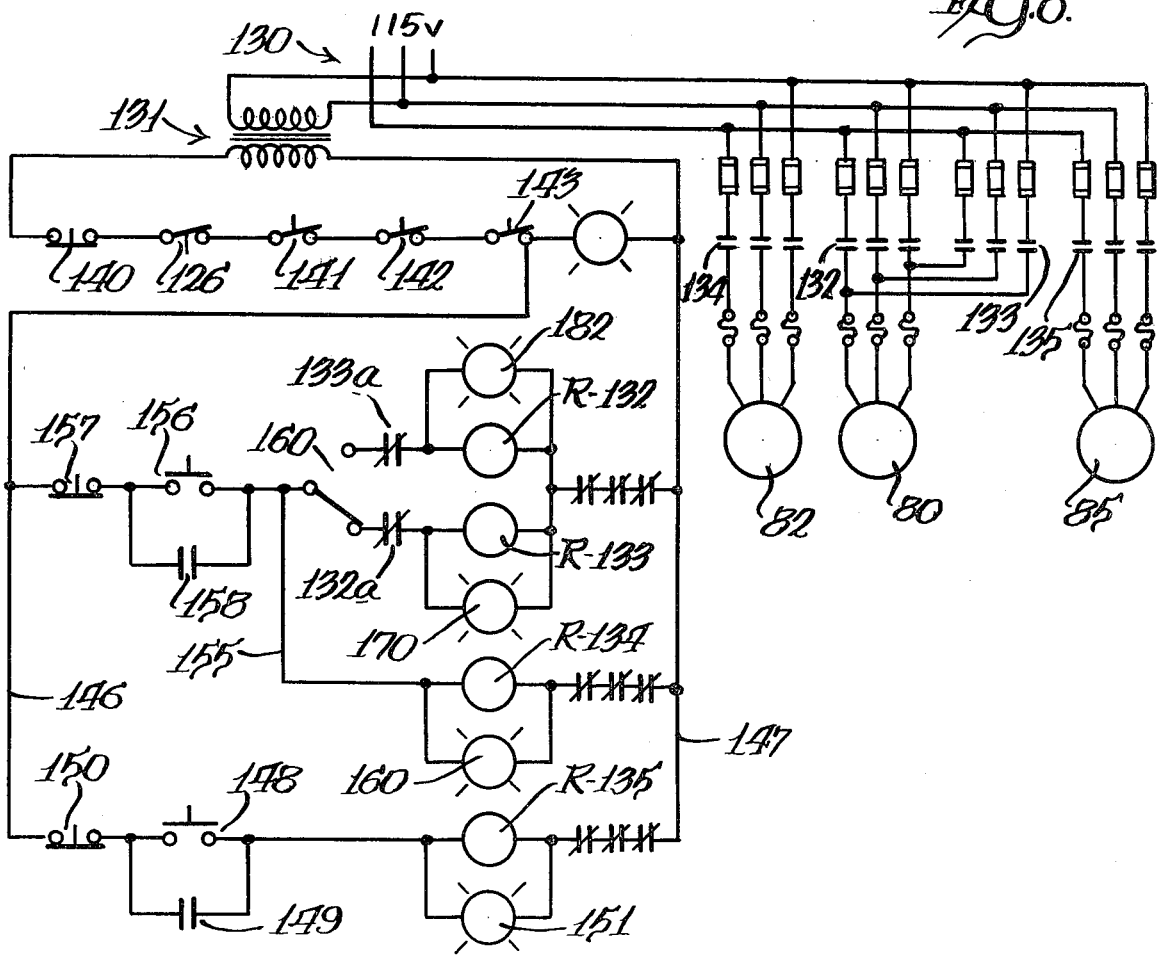
FIG. 6 is a wiring diagram for the skin washer.

The electrical circuit for the skin washer is shown in the wiring diagram of FIG. 6 wherein the power lines, indicated generally at 130, provide power to a transformer, indicated generally at 131, and to the motors 80, 82 and 85 through connections including relay contacts. The reversible motor 80 for the first driven brush roller 60 is supplied with power through either the relay contacts 132 or the relay contacts 133 to provide the reversing of operation, while the motors 82 and 85 are supplied with power through the contacts 134 and 135. The control circuit supplied by the transformer 131 has a series of interlock switches providing for discontinuance of operation under certain conditions and opening the power circuit to the control relays for the motors. These interlock switches include the switch 126, previously referred to, as well as an emergency stop switch 140, a pair of chain guard interlock switches 141 and 142 and an access door switch 143. The access door switch is associated with a door 144, shown in FIG. 1, while one of the chain guards is shown at 145 in FIG. 1. The relay R-135 is connected across the lines 146 and 147 and may be energized by closure of the start switch 148 to close the relay contacts 135, in which case they are held closed by a holding relay contact 149 until the stop switch 150 is opened or one of the interlock switches is opened. A signal light 151 indicates energization of the relay R-135.

The relay R-134 for the relay contacts 134 is connected across the lines 146 and 147 by a line 155 which includes a start switch 156 and a stop switch 157. The switches 156 and 157 operate in a similar fashion as the start and stop switches 148 and 150 previously described, the start switch 156 having connected thereacross a normally open holding relay contact 158 analogous to relay contact 149 which is energized by the relay R-134. Energization of the relay R-134 causes operation of a signal light 160 and of the motor 82 for operating the second driven brush 61.

The drive of the first driven brush roller 60 is also subject to operation of the start and stop switches 156 and 157 but a switch 160 is provided for controlling one or the other of the relays R-132 and R-133 which, in turn, control the respective relay contacts 132 and 133 to drive the motor 80 in either a forward (skin advancing) or reverse direction. The switch 160 is shown in FIGS. 2, 4 and 5 and has a switch arm 161 with a roller 162 positioned to contact the upper side of the conveyor belt section 50 and with the conveyor belt being held firmly in position by a frame member 163 which underlies the switch arm and is supported by frame members 164 and 165 extending from front to rear of the skin washer. When there is no skin in contact with the switch arm roller 162, the switch arm is positioned as shown in FIG. 5 and the motor 80 is operated in the direction to cause the first driven brush roller 60 to rotate in a counterclockwise direction shown in FIG. 5. At this time, the switch is positioned, as shown in the wiring diagram of FIG. 6, whereby the relay R-133 is energized to close the relay contacts 133 and energize an indicating light 170. When the switch arm is raised by the presence of a skin S, as shown in FIG. 4, the switch shifts to the normally-open position in the wiring diagram whereby the relay R-132 is energized to close the relay contacts 132 and cause operation of the motor 80 in a direction resulting in clockwise rotation of the first driven brush roller 60, as shown in FIG. 4. This latter operation occurs as soon as a skin leading edge shifts the switch arm to the position shown in FIG. 4 and continues until the trailing edge of the skin leaves the switch whereby the driven brush roller 60 will rotate counterclockwise well in advance of the end of the skin reaching the washing station. In the event it is desired to adjust the time of respective operation of the driven brush roller 60, the switch 160 is adjustable lengthwise of the conveyor belt section 50 by having a mounting bracket 180 therefor adjustable along a rod 181 which extends in a direction lengthwise of the path of travel of the conveyor belt 35.

Referring back to the wiring diagram of FIG. 6, energization of the relay R-132 causes a signal light 182 to indicate that the first driven brush roller 60 is not rotating in the correct direction for insertion of a skin into the washing station. It will be noted that there are relay contacts 132*a* and 133*a* cross-connected with respect to the relays R-132 and R-133 whereby inadvertent movement of the contact arm 161 for the switch 160 will not cause inadvertent change in rotation of the driven brush roller 60.

With the skin washer disclosed herein, an operator can load and unload skins at one end of the machine because of the generally vertical path of travel of a skin through the washing station enabling return of a skin to the loading station and with a good washing action obtained by the use of only two driven brush rollers which are positioned to obtain extensive brush contact because of the partial wrap of the skin therearound. With the structure of the second frame being located generally above the discharge point of the skin from the washing station, there is free access for conveying structure to transport a skin to the opposite end of the unit to a stacker or other structure, if desired. The control of the direction of drive for one brush roller assures positive taut feeding of a skin through the washing station with adjustability in the control provided by the adjustable mounting of the switch 160 and with automatic shut-down of the machine if a jam should occur. The machine is readily adjusted for different thickness of skins because of the adjustable mounting of the second frame to vary the spacing between the driven brush rollers and the structure associated with the conveyor belt 35. A minimal amount of water is required for washing, since it is only necessary to supply water to the limited number of driven brush rollers which is a lesser number than heretofore used.

We claim:

1. A skin washer comprising, a conveyor belt for conveying a skin to a washing station, a series of spaced-apart back-up members engaging one side of the conveyor belt at said washing station and defining a plane of support for the conveyor belt, and a pair of driven brush rollers at the opposite side of the conveyor belt and positioned opposite the spaces between the back-up members and across said plane of support to concavely deflect the conveyor belt and increase the arc of contact of said brush rollers with a skin supported on said opposite side of the conveyor belt.

2. A skin washer as defined in claim 1 wherein said plane of support is generally upright, said conveyor belt extends to a skin loading station at one end of the skin washer and a second conveyor extends between a position below said lowermost back-up member to a position generally below said loading station for return of a washed skin to said one end of the skin washer.

3. A skin washer as defined in claim 2 wherein said conveyors and back-up members are mounted on one frame, said brush rollers are mounted on another frame, and means for adjusting the position of one frame relative to the other to vary the position of the brush rollers relative to said plane of support and adjust for different thicknesses of skins to be washed.

4. A skin washer as defined in claim 1 wherein said driven brush rollers include a first brush roller which is driven by reversible drive means, and means for rotating said first brush roller in a direction to advance a skin to the succeeding brush roller as the skin enters the washing station and for rotating the first brush roller in an opposite direction prior to a skin leaving contact with the first brush roller to exert a reverse pull on the skin.

5. A skin washer as defined in claim 4 wherein said first brush roller normally rotates in said opposite direction which is opposite to the path of travel of a skin with said conveyor, and sensing means for determining the advance of a skin toward said first brush roller for reversing the rotation of the first brush roller to cause rotation thereof in a skin-advancing direction.

6. A skin washer as defined in claim 5 wherein said sensing means includes a switch positioned to overlie said conveyor belt in advance of said first brush roller and having a switch arm which is moved between first and second positions by contact with a skin on said conveyor.

7. A skin washer as defined in claim 6 wherein said switch is mountable at different distances from said first brush roller dependent on the length of the skin.

8. A skin washer as defined in claim 1 wherein said back-up members are driven rollers, means for driving said brush rollers and said back-up rollers, and sensing means for sensing a jammed skin at said washing station and stopping said drive means.

9. A skin washer having a loading station and a washing station, an endless conveyor belt travelling along a path through said loading station to said washing station, a plurality of vertically-spaced back-up rollers guiding said belt along a generally vertical path through said washing station, a plurality of driven brush rollers in vertically-spaced relation positioned relative to said back-up rollers to have the belt positioned therebetween, and conveying means having an end beneath the washing station for receiving a skin from said conveyor belt after washing thereof and delivering the skin to a discharge station.

10. A skin washer as defined in claim 9 wherein said discharge station is beneath said loading station.

11. A skin washer as defined in claim 9 wherein said plurality of driven brush rollers are positioned relative to the back-up rollers to have the conveyor belt follow a sinuous path through the washing station and increase the contact between a brush roller and a skin.

12. A skin washer having a base, a first frame fixed to and upstanding from said base, a second frame extending upwardly from said base in a position adjacent said first frame, means adjustably mounting said second frame for movement toward and away from said first frame, a skin washing station located between said frames including a plurality of spray nozzles, an endless conveyor belt mounted on said first frame for travel between a loading station and said washing station, a series of vertically-spaced driven back-up rollers on said first frame at one side of said conveyor belt at said washing station, a pair of vertically-spaced driven brush rollers on the second frame and at the opposite side of the conveyor belt and located to deflect portions of the belt between the back-up rollers into a partial wrap on the brush rollers, feed means for feeding a skin on the conveyor belt from a generally horizontal path into a generally vertical path at the washing station and toward a first of the brush rollers, means for removing a skin from the conveyor belt at a location beyond the washing station, and means for causing said pair of brush rollers to rotate in a skin-advancing direction as a skin initially enters and travels through said washing station and for causing said first brush roller to change direction of rotation and rotate in a skin-retarding direction in advance of a skin leaving the washing station to exert a resisting force on a trailing part of the skin as the skin advances through the washing station.

13. A skin washer as defined in claim 12 wherein said means for causing rotation of said brush rollers includes a reversible drive for said first brush roller, and a circuit including a switch operable by a skin for controlling the direction of the reversible drive.

14. A skin washer as defined in claim 13 wherein said first frame has a member underlying and supporting said conveyor belt in advance of the first brush roller, and said switch has a switch arm engaging said conveyor belt above said member whereby a skin will raise said switch arm to change the operative condition of the switch.

15. A skin washer as defined in claim 14 wherein said switch is mountable at different distances from said first brush roller dependent on the length of the skin.

16. A skin washer having frame means, a skin washing station including a plurality of spray nozzles, an endless conveyor belt mounted on said frame means for travel between a loading station and said washing station, a series of vertically-spaced driven back-up rollers at one side of said conveyor belt at said washing station, a pair of vertically-spaced driven brush rollers on the frame means and at the opposite side of the conveyor belt, and means for causing said pair of brush rollers to rotate in a skin-advancing direction as a skin initially enters and travels through said washing station and for causing a first of said brush rollers to change direction of rotation and rotate in a skin-retarding direction prior to a skin leaving the washing station to exert a retarding force on the trailing part of the skin.

17. A skin washer having frame means, a skin washing station including a plurality of spray nozzles, a relatively smooth endless conveyor belt mounted on said first frame for travel between a loading station and said washing station for transporting a skin through the washing station without gripping thereof, a series of back-up members at one side of said conveyor belt at said washing station, a pair of vertically-spaced driven brush rollers on the frame means and at the opposite side of the conveyor belt and located to deflect portions of the belt between the back-up members into a partial wrap on the brush rollers, means for causing one of said pair of brush rollers to continuously rotate in a skin-advancing direction, and means for causing a first of said brush rollers which first contacts a skin at the washing station to rotate in a skin-advancing direction as a skin initially enters and travels through said washing station and for causing said first brush roller to change direction of rotation and rotate in a skin-retarding direction prior to a skin leaving the washing station to exert a retarding force on the trailing end of the skin.

18. A skin washer having a skin washing station, a conveyor belt mounted for travel between a loading station and said washing station, a series of vertically-spaced driven back-up rollers at one side of said conveyor belt at said washing station, and a pair of vertically-spaced driven brush rollers at the opposite side of the conveyor belt and located to deflect portions of the belt and a skin carried thereby into a partial wrap on the brush rollers.

* * * * *